United States Patent [19]

Cunningham

[11] 4,209,986

[45] Jul. 1, 1980

[54] METHOD OF AND APPARATUS FOR AUXILIARY CONTROL OF FLUID OPERATED STEERING APPARATUS FOR SHIPS, BOATS AND THE LIKE

[76] Inventor: Robert F. Cunningham, 3 Willow Crest Dr., Katonah, N.Y. 10536

[21] Appl. No.: 897,146

[22] Filed: Apr. 17, 1978

[51] Int. Cl.[2] ..... F15B 20/00

[52] U.S. Cl. ..... 60/403; 60/327; 60/484; 91/509; 114/150

[58] Field of Search ..... 60/327, 403, 404, 405, 60/418, 484; 91/411 R; 114/150

[56] References Cited

U.S. PATENT DOCUMENTS

| | | | |
|---|---|---|---|
| 1,955,922 | 4/1934 | Lamond | 60/428 |
| 2,175,800 | 10/1939 | Hodgman | 114/144 |
| 2,512,119 | 6/1950 | Stone et al. | 60/403 X |
| 2,591,641 | 4/1952 | Troendle | 137/78 |
| 2,595,248 | 5/1952 | Greer et al. | 60/404 |
| 2,702,615 | 2/1955 | Morse | 192/0.096 |
| 2,796,737 | 6/1957 | Harger | 60/567 |
| 2,892,310 | 6/1959 | Mercier | 60/385 |
| 2,979,070 | 4/1961 | Payne | 137/192 |
| 3,018,628 | 1/1962 | Pomper | 60/403 X |
| 3,234,853 | 2/1966 | Aber | 91/4 |
| 3,295,488 | 1/1967 | Hinsch et al. | 114/150 |
| 3,349,744 | 10/1967 | Mercier et al. | 114/150 |
| 3,468,126 | 9/1969 | Mercier | 60/384 |
| 3,488,154 | 1/1970 | Hronas | 23/230 |
| 3,680,311 | 8/1972 | Harbonn et al. | 60/404 |
| 3,739,803 | 6/1973 | Ferrentino | 137/255 |
| 3,797,744 | 3/1974 | Smith | 239/172 |
| 3,909,205 | 9/1975 | Jones | 23/259 |

*Primary Examiner*—Edgar W. Geoghegan
*Attorney, Agent, or Firm*—Morgan, Finnegan, Pine, Foley & Lee

[57] ABSTRACT

Auxiliary control of fluid actuated steering apparatus for ships, boats and the like (hereinafter, "water vessels") includes isolating the existing steering control system from the steering apparatus and providing flow-communication between fluid under pressure and the steering apparatus through an auxiliary directional control sub-system enabling control of the steering apparatus independently of the main steering control system. According to a preferred embodiment, the source of the fluid includes a quantity of fluid stored under pressure and another quantity of fluid adapted to be provided under pressure. Isolation of the existing steering control system is carried out by coupling the source of fluid to a by-pass control sub-system preferably adapted both to isolate the main steering control system and to couple the auxiliary directional control sub-system to the steering apparatus. Initiation of the auxiliary steering control may be carried out by electrical, hydraulic or pneumatic actuation or, preferably, by a combination thereof.

37 Claims, 8 Drawing Figures

METHOD OF AND APPARATUS FOR AUXILIARY CONTROL OF FLUID OPERATED STEERING APPARATUS FOR SHIPS, BOATS AND THE LIKE

BACKGROUND AND OBJECTS OF INVENTION

The present invention relates generally to fluid operated steering apparatus, such as hydraulically operated steering apparatus used on ships, boats and the like (hereinafter, "water vessel"), and, more particularly, to a method of and apparatus for auxiliary control of fluid operated steering apparatus to enable control of the steering apparatus in the event the main steering control system becomes defective or completely inoperable.

The recent trend in constructing ocean-going cargo ships has been towards more complex and greater tonnage vessels capable of transporting large quantities of potentially dangerous cargo, such as crude oil or liquified natural gas, etc. Although the chances of a serious mishap are slight when the vessel is on the open seas, the possibility of such occurrence is greatly increased when the vessel is in shallow waters or in harbors or other congested areas. Under these circumstances, one of the greatest causes of serious accidents has been the loss in steering capability, resulting in collisions with nearby vessels, docks or other obstructions.

In general, the steering apparatus in such water vessels are hydraulically operated and the steering control systems therefor include a somewhat complex combination of mechanical, hydraulic and electrical devices, such as disclosed in U.S. Pat. Nos. 2,892,310 and 3,468,126, both issued to Mercier. Although the hydraulic steering control systems provide satisfactory operation under normal conditions, the component devices are all susceptible to failure and the entire steering control system can be rendered inoperable. These steering control systems provide no reliable and conveniently operable means for enabling control of the steering apparatus when the main steering control system is rendered inoperable. Rather, they merely include manual control devices which permit limited control of the steering mechanism.

While manually operable devices may permit some steering control of the vessel, several drawbacks are evident. For example, since the manually operable devices are usually located in the steering gear room or other areas physically separated from the bridge, the steering commands issued by those in the bridge, who can observe the vessel's heading and its surroundings, can be misunderstood or too slowly carried out by those operating the manual control devices. Thus, the vessel can be inadvertently mis-directed into an accident.

Another proposal for providing auxiliary steering control involves at least partially duplicating the devices of the steering control system. Although redundancy of hardware may offer satisfactory operation in certain situations, it would be unduly expensive, space consuming and not necessarily fool-proof. For example, if the vessel's electrical system failed, all electrically operated components in both the existing and the redundant steering control systems would be inoperable, thereby rendering the redundant system ineffective.

Accordingly, it is an object of the present invention to provide new and improved method of and apparatus for auxiliary control of fluid-operated steering apparatus in water vessels. It is also an object of the present invention to provide a new and improved auxiliary control system for fluid-operated steering apparatus, and a method of carrying out same, which is available for essentially immediate utilization when the main steering control system is rendered defective or completely inoperable.

In addition, it is an object of the invention to provide a new and improved method of and apparatus for auxiliary control of fluid-operated steering apparatus in water vessels, which can be initiated directly from the same location where the main steering control system is operated.

Another object of the invention is to provide a new and improved method of and apparatus for auxiliary control of fluid-operated steering apparatus in water vessels, which can be conveniently incorporated into virtually any type of conventional fluid-operated steering apparatus.

It is an additional object of the present invention to provide a new and improved method of and apparatus for auxiliary control of fluid-operated steering apparatus in water vessels, which can be implemented by means independent of the main power source or any other power source for the main steering control system.

It is yet another object of the present invention to provide a new and improved method of and apparatus for auxiliary control of fluid-operated steering mechanisms in water vessels, which can provide at least limited control of the steering mechanism without requiring any electrical power.

It is a further object of the present invention to provide a new and improved method of and apparatus for auxiliary control of fluid-operated steering mechanisms in water vessels, which is completely independent of the main steering control system.

Objects and advantages of the invention are set forth in part above and in part below. In addition, these and other objects and advantages of the invention will become apparent herefrom, or may be appreciated by practice with the invention, the same being realized and attained by means of the instrumentalities, combinations and methods pointed out in the appended claims. Accordingly, the present invention resides in the novel parts, constructions, arrangements, improvements, methods and steps herein shown and described.

SUMMARY OF THE INVENTION

Briefly described, the method of and apparatus for providing auxiliary control of fluid-operated steering apparatus, according to the present invention, comprises isolating the main steering control system from operable coupling with the steering apparatus and providing operable flow communication between a source of fluid and the steering apparatus for enabling directional control of the steering apparatus by the fluid when initiation of auxiliary steering control is desired. The fluid is maintained at least in part under pressure and, as preferably embodied, is also utilized both to isolate the existing steering control system and to operatively couple the auxiliary directional control system to the steering apparatus.

In accordance with the invention, the source of fluid may include a quantity of fluid which is stored under pressure and a quantity of fluid which is capable of being provided under pressure, as by pumping. As preferably embodied, the source of pressurized fluid is coupled to both a by-pass control sub-system adapted to distribute the pressurized fluid in such a way as to isolate the main steering control system from the steering apparatus as well as to an auxiliary directional control sub-system adapted to permit operable fluid flow into and out of the steering apparatus for effecting desired directional actuations of the steering apparatus.

Also in accordance with the invention, initiation of auxiliary steering control may be carried out by two independent actuation means. Fluid flow through both the by-pass control sub-system and the auxiliary directional control sub-system can be initiated by electrical actuation or by fluid actuation. As preferably embodied, the fluid actuation is carried out completely by fluid from the pressurized stored-fluid sub-system.

Accordingly, it will be apparent from the foregoing general description that the objects and advantages of the invention specifically enumerated herein are achieved by the invention as herein embodied. Thus, for example, it will be found that auxiliary control of fluid-operated steering apparatus may be provided in accordance with the present invention, enabling relatively quick and reliable control of the steering apparatus when the main steering control has become defective or has been rendered completely inoperable.

It will also be found that by providing auxiliary steering control utilizing pressurized fluid, the auxiliary steering control according to the present invention may be easily and conveniently adapted for use with essentially any fluid-operated steering apparatus, independent of the main steering control system.

In addition, by providing auxiliary steering control utilizing electrical as well as other actuation, particularly fluid actuation, it will be found that initiation of auxiliary steering control can be carried out directly from the same location as the main steering control.

It will further be found that by providing a quantity of fluid under pressure, auxiliary control of the steering apparatus can be initiated and control of the steering apparatus can be carried-out in a relatively short time. In addition, sufficient auxiliary steering power will thereby be available to enable operation of the steering apparatus despite any resistance to operation of the steering apparatus, such as, for example, strong water currents acting against a ship's rudder. Furthermore, the stored quantity of pressurized fluid enables auxiliary control of the steering apparatus despite the loss of all electrical power and/or the inoperability of both the main steering control and the electrically operated auxiliary steering control.

Also, by providing isolation capability both to by-pass existing steering control from the steering apparatus and to access auxiliary directional control to the steering apparatus, it will be found that the auxiliary steering control according to the present invention will not interfere with normal operation of the main steering control system.

It will be understood that the foregoing general description as well as the following detailed description are exemplary and explanatory of the invention, but are not restrictive thereof. To this end, the accompanying drawings referred to herein and constituting a part hereof, illustrate preferred embodiments of the invention and, together with the description, serve to explain the principles of the invention.

DETAILED DESCRIPTION OF PREFERRED EMBODIMENT

Referring generally to the embodiments of the invention shown in the accompanying drawings, wherein like reference numbers refer to like parts throughout the various views, there is illustrated, in FIGS. 1–6, an embodiment of an auxiliary steering control system according to one aspect of the present invention.

As shown in FIGS. 1–6, the auxiliary steering control system is adapted for use in a water-going vessel and is coupled to the existing steering apparatus (indicated generally at 10) which is a dual ram-cylinder operated rudder. The ram cylinders are indicated at 12, 14, 16 and 18, and the rudder is indicated at 11. However, it will be understood that the present invention is equally applicable to vane, link and clevis type steering gear as well as to any other fluid controlled steering apparatus used in ships, boats and the like.

Stored-Energy Fluid Power System

Figure 1:
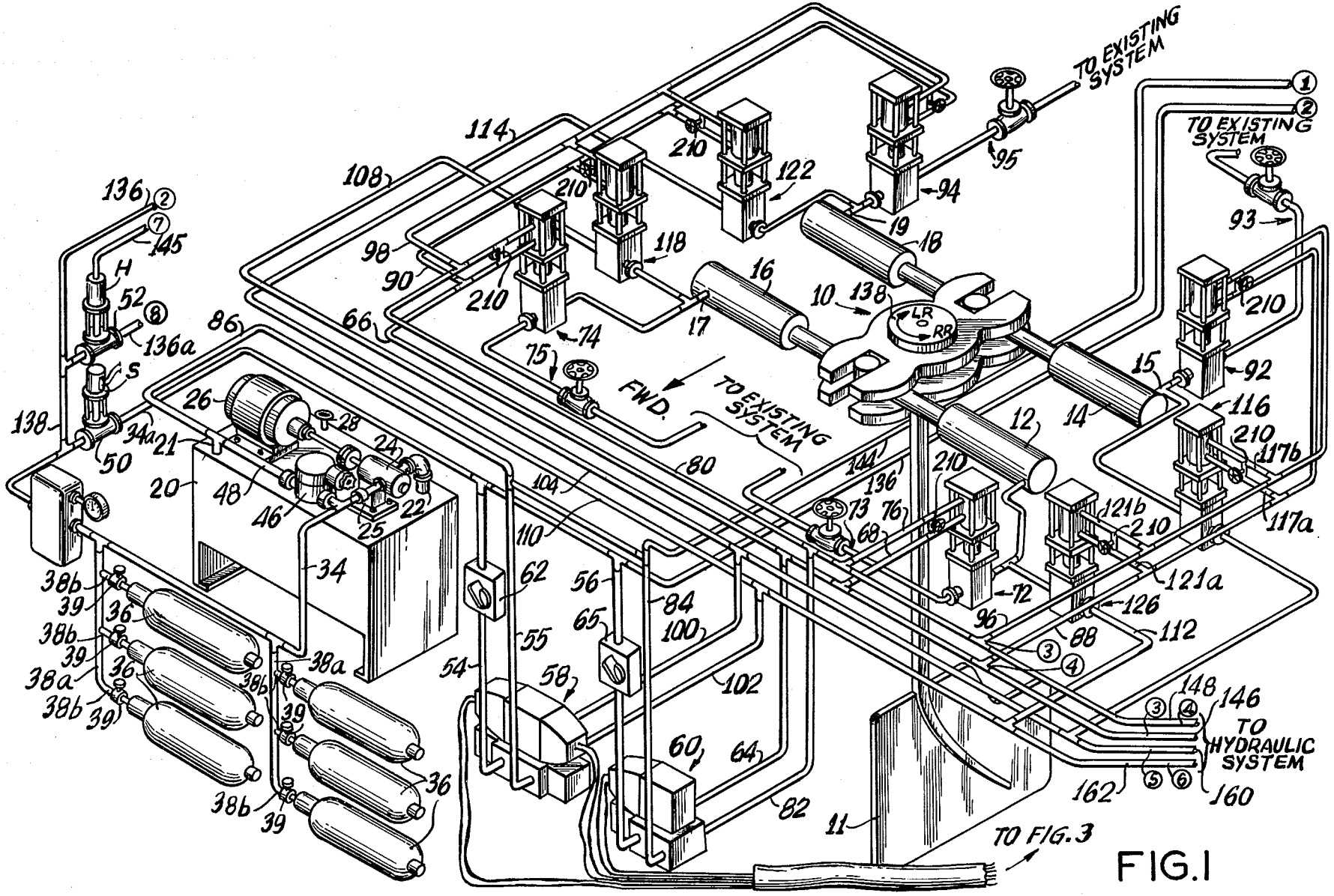
FIG. 1 is a perspective view of an embodiment of the auxiliary steering control system according to the present invention.
Figure 2:
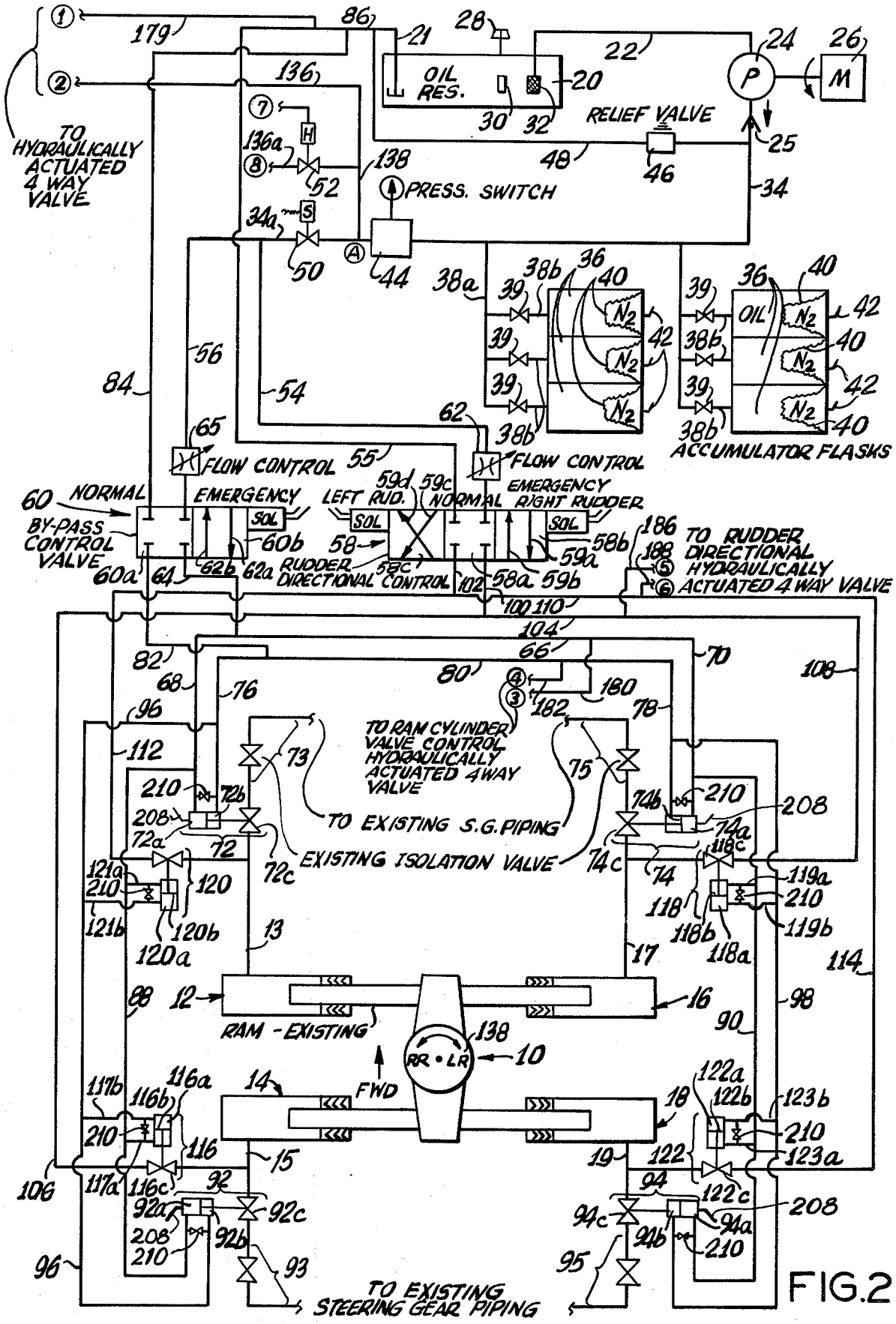
FIG. 2 is a diagramatic view of the system shown in FIG. 1.
Figure 3:
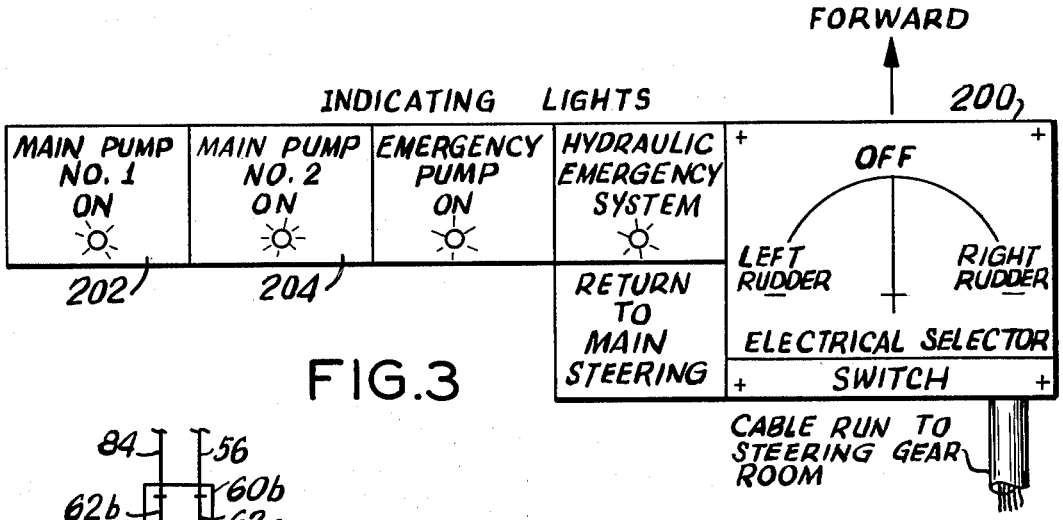
FIG. 3 is a block diagram of an electrical control panel for the system shown in FIG. 1.

In the illustrative embodiment, the auxiliary steering control system includes a stored-energy fluid power sub-system adapted to maintain a quantity of fluid at a predetermined pressure level. To this end, reservoir 20, shown in FIGS. 1 and 2, is filled with a predetermined level of fluid (typically a hydraulic fluid such as oil) and is furnished with outlet conduit 22 providing fluid communication between reservoir 20 and pump 24, with motor 26 operably coupled to pump 24 for pumping fluid, under pressure, to the rest of the stored-energy sub-system, as described more fully below. It will be understood that reservoir 20 may have a conventional venting device (indicated at 28), a fluid-level viewing window 30 and strainer 32 at the entrance to outlet conduit 22 for preventing small particles or other impurities from entering the fluid conduits. In addition, pump/motor assembly 24/26 may be operated by the vessel's main power supply, or by an independent power source (e.g., storage batteries) to enable operation despite failure of the vessel's main power supply, or by a pneumatic motor or the like. Also, one-way flow valve 25 may be located downstream of pump 24 to prevent fluid from flowing back into the pump.

Also shown in FIGS. 1–2, a plurality of pressurizable fluid accumulators (each indicated generally at 36) are provided in flow communication with pump 24 by conduit 34 which is located, flow-wise, on the opposite side of pump 24 from reservoir 20. Accumulators 36 are coupled to conduit 34 by branch conduits 38*a*, with each accumulator 36 coupled to a branch conduit 38*a* by a separate lead conduit 38*b*. Each lead conduit 38*b* may include a manual shut-off valve 39, such as a globe shut-off valve, for isolating its corresponding accumulator 36 to permit, for example, recharging of the gas retained therein or other necessary maintenance. When opened, each valve 39 permits flow of fluid stored in the accumulator to the various portions of the auxiliary control system, as described more fully below, as well as flow of fluid from pump/motor 24/26 into accumulators which have become depleted.

As preferably embodied, accumulators 36 are adapted to store hydraulic fluid at a predetermined pressure. To this end, each accumulator 36 may, for example, be a bladder-type accumulator such as sold by Miller Fluid Power Corp., which includes diaphram means for enabling a gas (such as nitrogen) under pressure to be contained within each accumulator 36 along with the stored fluid yet without inter-mixing with the fluid. The diaphram means in each accumulator may comprise a flexible and expandible bag 40 (FIG. 2), preferably attached to one endwall of the accumulator and adapted to admit the gas at a predetermined "charging" pressure. A pressure gauge (indicated at 42 and coupled to each gas bag 40) may be provided outside each accumulator 36 for indicating the pressure of gas contained therein. Other suitable accumulators such as the piston type sold by Vickers Inc. may be utilized.

As will become more evident below, fluid from reservoir 20 and/or accumulators 36 does not flow past junction point (A) in conduit 34 under normal steering operation—i.e., while the vessel's main fluid-operated steering control system is functioning. Thus, fluid is pumped from reservoir 20 into each accumulator 36 until the pressure of the fluid pumped therein equals that of the gas in gas bags 40.

To this end, adjustable pressure switch 44 is positioned in conduit 34, in flow communication with pump 24 and accumulators 36. The pressure switch is adapted to detect the pressure in conduit 34 and generate an output signal, coupled to motor 26, for activating the motor (and thereby energizing pump 24) when the pressure falls below predetermined level and for deactivating motor 26 when the pressure reaches another predetermined level. For example, gas in bags 40 may be pre-charged to a pressure of about 1,500 psig (for convenience, hereinafter, all pressure values will be understood to be in terms of "psig") and fluid is pumped into accumulators 36 until the overall fluid pressure reaches 3000 psi. Thus, pressure switch 44 may be set at 2000 or 2500 psi so that when the pressure in fluid line 34, (and, therefore, in accumulators 36) drops below that level, motor 26 is energized for pumping more fluid into the accumulators until the pressure of about 3000 psi (the upper level of pressure switch 44) is achieved. Thereafter, the motor is shut off.

In order to protect the devices in the stored-energy fluid power system from damage due to overpressurization in the system (e.g. if motor 26 does not shut off), relief valve 46 is positioned in conduit 48 which provides fluid communication between conduit 34 and reservoir 20 (as by reservoir inlet conduit 21). Relief valve 46 is adapted to open and permit flow through conduit 48 when the fluid pressure in conduit 34 exceeds a prescribed limit, thereby to prevent over-pressurization in the stored-energy fluid power system. As preferably embodied, relief valve 46 is set at about 10–15% over the predetermined capacity for accumulators 36. For example, where accumulators 36 are adapted to contain fluid at about 3000 psi, relief valve 46 can be set at between about 3300 psi and about 3450 psi.

Thus, the stored-energy portion of the auxiliary steering control system according to the invention provides a constant quantity of pressurized fluid which is immediately available for use in the auxiliary steering control system when initiated, as well as a quantity of fluid which can be provided under pressure for use in the auxiliary steering control system. Fluid in the stored-energy sub-system can be utilized both for operating steering apparatus 10 and for operating the by-pass control sub-system which isolates the main steering control system from steering apparatus 10 and couples the auxiliary directional control sub-system to the steering apparatus, all as described more fully below.

ELECTRICAL INITIATION OF AUXILIARY STEERING CONTROL

According to one aspect of the invention, initiation of the auxiliary steering control is carried out electrically by, for example, shifting the electrical auxiliary selector (indicated at 200 in FIG. 3) when a failure is detected in the main steering control system (e.g., by one or both pump indicator lights 202 and 204 (FIG. 3) going out, by some alarm system, or by failure of the rudder to respond, etc.).

The solenoid, S, of solenoid-operated valves 50 (located in conduit 34*a*) is coupled to selector 200 (FIG. 3) for activation when indicator 200 is moved from the "OFF" position. When activated, solenoid valve 50 is opened to permit flow of pressurized fluid in the stored-energy sub-system from conduit 34 to auxiliary directional system lead conduit 54 and also to by-pass lead conduit 56. Lead conduit 54 is coupled to directional control valve 58 which is adapted to introduce the fluid into the appropriate portions of the auxiliary directional control sub-system for enabling a left turn or a right turn maneuver. Lead conduit 56 is coupled to by-pass control valve 60 which is adapted to introduce the fluid into the remainder of the by-pass control sub-system for isolating the main steering control system and coupling the auxiliary directional control sub-system to steering apparatus 10.

As here embodied, directional control valve 58 and by-pass control valve 60 are both electrically actuated four-way directional control valves, with solenoids (SOL) coupled to selector 200. Valve 58 may, for example, be a double solenoid, spring-centered, solenoid-operated four-way directional control valve, such as the Series DG–4S4 (closed center all ports) sold by Vickers, Inc. Valve 60, for example, may be a single solenoid, spring-offset, solenoid-operated four-way directional control valve, such as sold by Vickers, Inc. under the same general Series designation. It will be understood that the size and capacity of valves 58 and 60 will be selected so as to be compatible with size and capacity of the remainder of the auxiliary steering control system in accordance with the usual sizing formulations.

When selector 200 is moved to the Right Rudder position, by-pass control valve chamber 60*b* is moved into the flow path in control valve 60, and flow-enabling valve chamber 58*b* is moved into the flow path of control valve 58. Similarly, when selector 200 is moved to the Left Rudder position, by-pass control valve chamber 60*b* is moved into the flow path of control valve 60 (or maintained in the flow path if auxiliary steering control has already been initiated) and flow-enabling valve chamber 58*c* is positioned in the flow path of control valve 58. In addition, flow control devices 62 and 65, which may be variable orifice devices, are positioned in conduits 54 and 56, respectively, for controlling the amount of flow therein and, therefore, into their corresponding control valves 58 and 60, respectively.

Electrically Operated By-Pass Control System

Taking first the electrically operated by-pass control sub-system, flow-blocking chamber 60*a* is normally positioned in the flow path of control valve 60—i.e., in the path of conduits 56 and 84—to prevent fluid from flowing into the by-pass system in the event fluid may leak past valve 50. However, when the solenoid of control valve 60 is energized (preferably simultaneously with solenoid valve 50), flow-enabling chamber 60*b* is positioned in registration with conduits 56 and 84. Flow conduit 62*a* in chamber 60*b* is adapted to provide flow communication between input conduit 56 and lead 64 coupled to valve 60 and flow conduit 62*b* is adapted to provide flow communication between output conduit 84 (described below) and return conduit 82 (also described below).

Conduit 64, in turn, is coupled to by-pass distributor conduit 66 for distributing the fluid in the by-pass control sub-system which, as here embodied, includes fluid-operated valve means for isolating the main steering control system from the steering apparatus. To this end, distributor conduit 66 is coupled both to first branch conduit 68 and to second branch conduit 70 which, in turn, are coupled, respectively, to first isolation valve assembly 72 and second isolation valve assembly 74. Isolation valve assemblies 72 and 74 are adapted to isolate ram cylinders 12 and 16, respectively, from the existing steering control system.

As here embodied, each valve assembly 72 and 74 includes chamber/piston assembly, 72*a*/72*b* and 74*a*/74*b*, respectively, and a shut-off valve, 72*c* and 74*c*, respectively, which valves are operated by the corresponding chamber/piston assembly. Thus, branch conduits 68 and 70 are coupled to one end of chambers 72*a* and 74*a*, respectively, so that fluid from the stored-energy fluid power system will flow into the chambers to act on one side of the piston (72*b* and 74*b*, respectively) contained therein. In addition, exit conduits 76 and 78 are coupled to the other ends of chambers 72*a* and 74*a*, respectively, to provide a relief outlet for any fluid on the other side of the pistons.

Advantageously, exit conduits 76 and 78 are both coupled to collector conduit 80 which, in turn, is coupled to reservoir return conduit 82, leading back into control valve 60. As indicated above, return conduit 82 is adapted to be aligned with conduit 62*b* of chamber 60*b* when valve 60 is in the flow-enabling configuration. In such configuration, conduit 62*b* is also coupled to conduit 84 which, in turn, leads to reservoir inlet collector conduit 86 for returning fluid into reservoir 20 via inlet 21.

Where more than one pair of ram cylinders are utilized for operating rudder 11, the auxiliary system by-pass control is also adapted to isolate the portion of the main steering control system, which controls the additional ram cylinders. For this purpose, third branch conduit 88 and fourth branch conduit 90 are coupled to by-pass distributor conduit 66 for operating third isolation valve assembly 92 and fourth isolation valve assembly 94, respectively, which may be similar to valve assemblies 72 and 74. Branch conduit 88 provides flow communication between first branch conduit 68 and inlet portion of chamber 92*a*, and branch conduit 90 provides flow communication between second branch conduit 70 and the inlet of chamber 94*a*.

In addition, return conduits 96 and 98 are provided for relieving any fluid pressure in the other portions of chambers 92*a* and 94*a*, respectively, similar to return conduits 76 and 78. Thus, return conduit 96 provides flow communication between the outlet side of cylinder 92*a* and return conduit 76, and return conduit 98 provides flow communication between the other end of chamber 94*a* and return conduit 78.

It will be understood that conduits 88, 90, 96 and 98 could be coupled directly to their corresponding distributor and return conduits (66 and 80), rather than to the branch conduit, 68, 70, 76 and 78. However, the staggered fluid coupling in the embodiment herein described is preferred since it minimizes the total length of conduits required without substantially affecting the response time for completely initiating auxiliary steering control in accordance with the invention. It also helps minimize the amount of fluid needed to isolate the main control system and thereby leave more fluid for actually controlling the steering apparatus.

It will also be understood that the fluid flowing in the by-pass control sub-system may also be utilized for controlling other operations in the auxiliary steering control system, particularly, for operating additional isolation valve assemblies 116, 118, 120 and 122 which couple the auxiliary steering control system conduits to the steering apparatus 10, as will be described more fully hereinafter.

Figure 4:
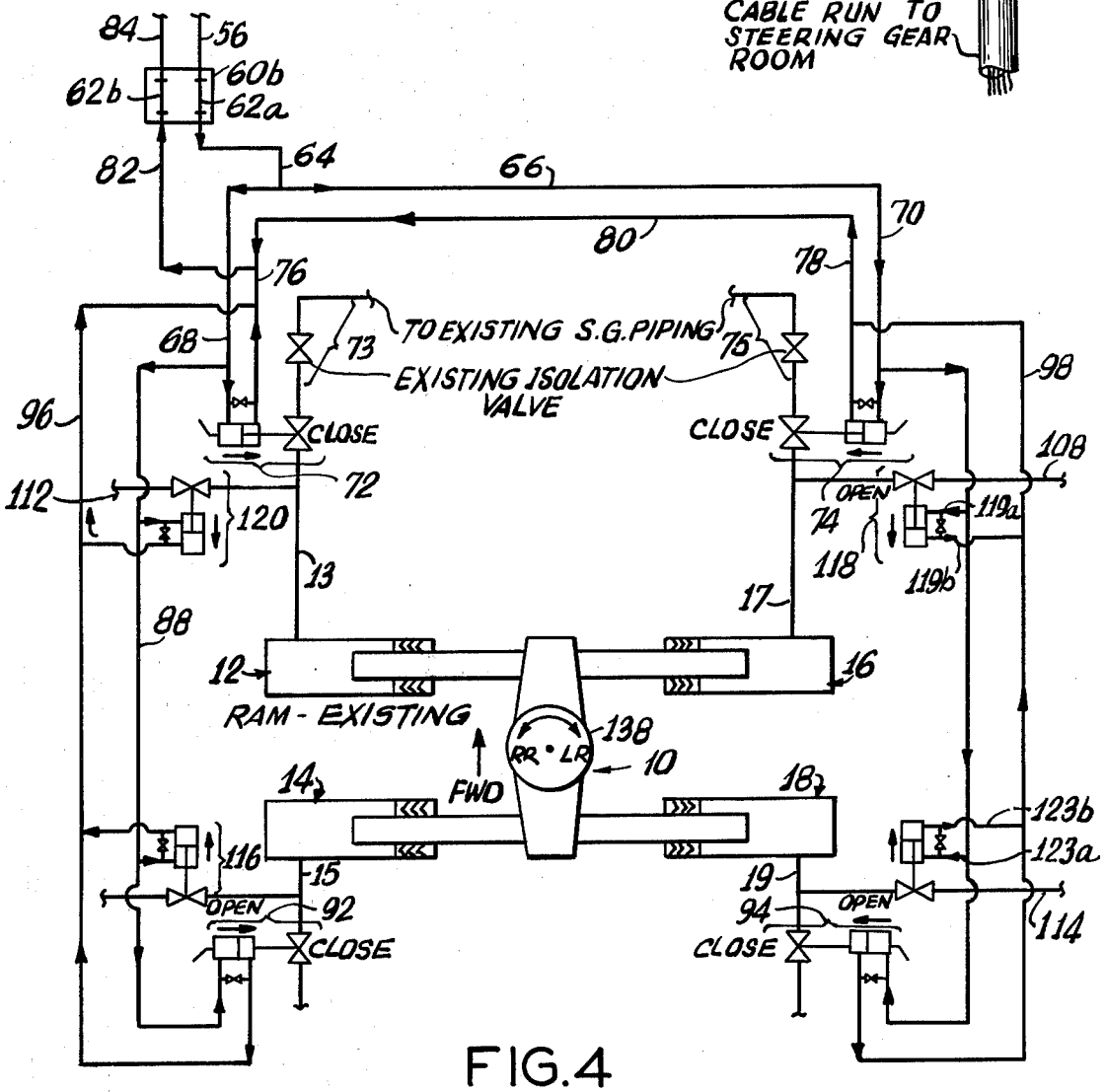
FIG. 4 illustrates the fluid flow pattern in a portion of the system diagramatically illustrated in FIG. 2 when auxiliary steering control is initiated according to the invention.

Referring now to FIG. 4, there is shown a schematic flow diagram of the by-pass control sub-system according to the present invention. Ignoring, for the moment, the presence of valve assemblies 116, 118, 120 and 122 in FIG. 4, when the auxiliary control system is initiated, valve 50 is opened by activation of solenoid S and chamber 60*b* is positioned in the flow path of valve 60 by activation of solenoid SOL. Fluid from the stored-energy fluid power sub-system is permitted to flow into conduit 56 by the opening of valve 50. The fluid thence flows through conduit 62*a* (which has been aligned with conduit 56), through conduit 64 and into distributor conduit 66 wherein the fluid flow splits into the first and second branch conduits, 68 and 70. Fluid in branch conduit 68 flows into chamber 72*a* wherein it acts on piston 72*b* to move the piston (here to the right) so as to close valve 72*c*, thereby isolating ram cylinder 12 from the conduit (indicated at 73) leading to the main steering control piping. In addition, as piston 72*b* moves to the valve-closure position, any fluid pressure on the other side of piston 72*b*, due to residual fluid in the other partitioned portion of cylinder 72*a*, can be relieved since the fluid can exit via conduit 76 and return to reservoir 20 through conduits 82, 62*b*, 84, 86 and reservoir inlet 21.

Simultaneously, the other split portion of fluid in conduit 66 flows through second branch conduit 70 and into the first partitioned portion of chamber 74*a*, wherein it acts against piston 74*b* to force the valve 74*c* into the closure position. In addition, fluid on the other side of piston 74*b* in chamber 72*a* can exit therefrom through exit lead 78, into collector conduit 80 from which it can return to reservoir 20 through conduits 82, 62*b*, 84 and 86 and reservoir inlet 21, as explained above. Accordingly, closure of valve 74*c* isolates ram cylinder 16 from the conduit (indicated at 75) leading to the main steering control piping.

Concurrent with the closure of valves 72c and 74c, further pressurized fluid introduced into distributor conduit 66 flows both into third branch conduit 88 and into fourth branch conduit 90. Fluid in conduit 88 thence flows into the first partitioned portion of chamber 92a, forcing piston 92b (to the right) to close valve 92c and, thereby, isolate ram cylinder 14 from the conduit (indicated at 93) leading to the main steering control system. Meanwhile, any fluid in the other partitioned portion of cylinder 92a will flow through return conduit 96 back to reservoir 20 through conduit 76 substantially as described above. It will be understood that exiting fluid flowing into conduit 96 will flow through conduit 76 to reservoir 20, rather than into chamber 72a, because the route to the reservoir provides essentially no resistance to flow, and therefore, represents the path of least resistance.

Similarly, the portion of the further pressurized fluid, which enters conduit 90, flows into the first partitioned portion of chamber 94a forcing piston 94b to close valve 94c, thereby isolating ram cylinder 18 from the conduit (indicated at 95) leading to the main steering control system. Meanwhile, fluid in the other partitioned portion of chamber 94a can exit through exit conduit 98, thence through conduit 78 and back to reservoir 20 via conduit 80, as described above.

Electrically Operated Auxiliary Directional Control

Referring back to FIGS. 1 and 2, the electrically controlled auxiliary directional control sub-system includes solenoid-operated control valve 58 which, when activated, controls the flow of pressurized fluid into and out of the steering gear ram cylinders. As here embodied, control valve 58 includes flow-blocking chamber 58a, right-rudder flow-enabling chamber 58b and left-rudder flow enabling chamber 58c, each positionable in the flow path of control valve 58 for controlling the flow through lead conduits 100 and 102 which are coupled to the downstream flow path of control valve 58. Lead conduit 100 is coupled to collector/distributor conduit 104 which, in turn, is coupled both to fifth branch conduit 106 and to sixth branch conduit 108. Branch conduits 106 and 108 are coupled to ram cylinders 14 and 16, respectively, for either introducing pressurized fluid into both ram cylinders or allowing residual fluid in both ram cylinders to exit therefrom. Lead conduit 102 couples control valve 58 to collector/distributor conduit 110 which, in turn, is coupled both to seventh branch conduit 112 and to eighth branch conduit 114. Branch conduits 112 and 114 are coupled, respectively, to ram cylinders 12 and 18, for either introducing pressurized fluid into both ram cylinders or enabling residual fluid to exit from both ram cylinders.

According to another aspect of the present invention, the auxiliary control system is adapted not only to isolate the main steering control system but also to keep the auxiliary direction control system isolated from the steering apparatus until initiation of auxiliary steering control is desired. To this end, each of branch conduits 106, 108, 112 and 114 are coupled to their corresponding ram cylinder (14, 16, 12 and 18, respectively) via the lead conduits 15, 17, 13 and 19, respectively, which also form part of the main steering control system. Also, each branch conduit 106, 108, 112 and 114 includes a coupling valve assembly (indicated at 116, 118, 120 and 122, respectively), preferably controlled by the by-pass control system described above, in order to ensure that the presence of the auxiliary steering control system will have essentially no effect on the normal operation of the main steering control system. Moreover, it will be readily apparent that with such additional isolation valve assemblies, the auxiliary control system according to the present invention can be adapted for use with any conventional fluid-operating steering apparatus without having to make any substantial alterations to the apparatus.

Isolation valve assemblies 116, 118, 120 and 122 may be essentially identical to valve assemblies 72, 74, 92 and 94, described above with reference to FIGS. 1 and 2, and may, for example, be high pressure hydraulic valve sold as the Salem Model "108" by the Vickers Salem Valve Division of Sperry Rand Corp. Also, the valve members 116c, 118c, 120c and 122c are preferably positioned as close as possible to the junction of branch conduits 116, 118, 120 and 122, respectively, with their corresponding ram cylinder lead conduits (15, 17, 13 and 19, respectively) for enabling isolation of the auxiliary control system from the main control system in the immediate vicinity of the steering apparatus.

Turning again to FIG. 4, operation of valve assemblies 116, 118, 120 and 122 is carried out in essentially the same manner as and concurrently with valve assemblies 72, 74, 92 and 94 except that the shut-off valves members are opened instead of closed. Thus, pressurized fluid flowing in branch conduits 88 and 90 flows into cylinders 120a and 118a, respectively, via conduits 121a and 119a, respectively, thereby acting on pistons 120b and 118b, respectively, to open shut-off valves 120c *and 118c*, respectively. Meanwhile, any fluid on the other side of pistons 120b and 118b, tending to resist movement of the pistons, is permitted to exit from the cylinders by conduits 121b and 119b, respectively, which are coupled, respectively, to return conduits 96 and 98 for return to reservoir 20.

Similarly, further fluid in branch conduits 88 and 90 flows into cylinders 116a and 122a, respectively, through conduits 117a and 123a, respectively. The entering fluid acts on pistons 116b and 122b to open shut-off valves 116c and 122c, respectively, while any fluid on the other side of the pistons can exit through conduits 117b and 123b, respectively, for return to reservoir 20 via return conduits 96 and 98.

Right Turn Maneuver

Figure 5:
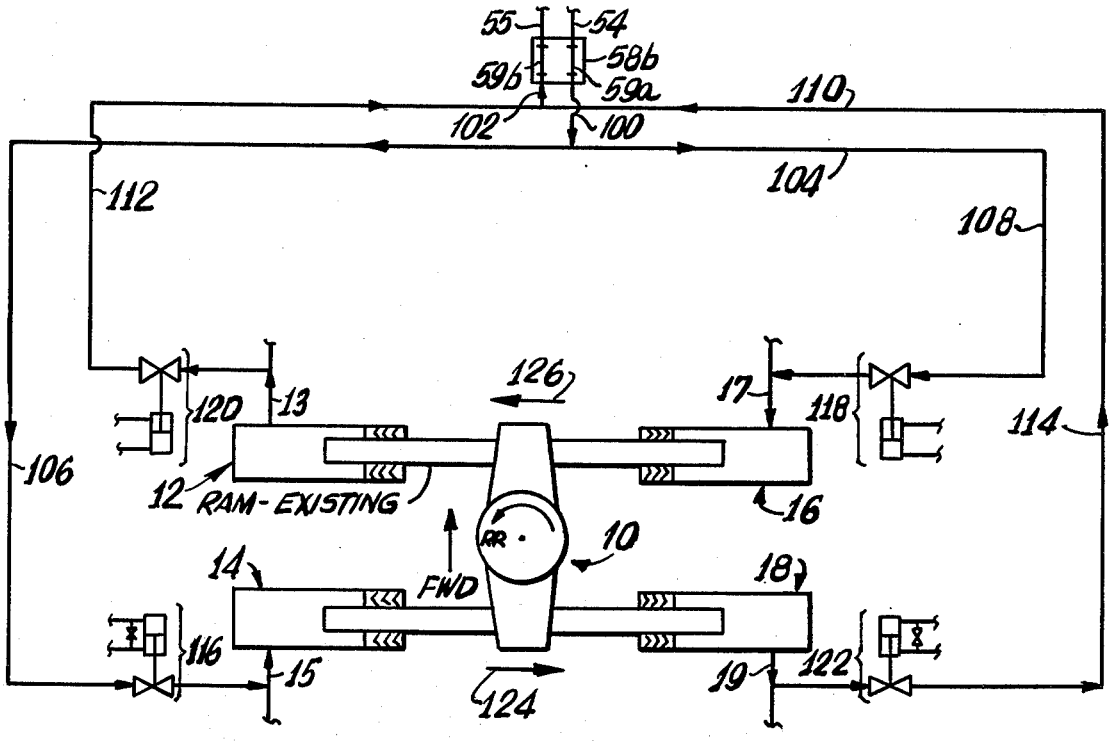
FIG. 5 illustrates the fluid flow pattern in another portion of the system diagramatically illustrated in FIG. 2 for a right turn maneuver by the auxiliary steering control according to the invention.

Turning now to FIG. 5, there is illustrated the fluid flow pattern of the auxiliary fluid directional control sub-system for the right turn maneuver. In operation, right-turn control chamber 58b is positioned in the flow path of control valve 58 by the solenoid controls, SOL, which may be carried out simultaneously with the opening of solenoid valve 50 by moving selector 200 to the right rudder position. For purposes of discussion, it is assumed that the by-pass control sub-system has, by-and-large, completed its operation as described above, so that valve assemblies 116c, 118c, 120c and 122c are assumed to be open, since flow through the auxiliary directional control sub-system will be blocked until these valves are opened.

During a right rudder maneuver, fluid from the stored-energy sub-system flows into conduit 54 (described above) thence through flow control 62 and into conduit 59a of control valve chamber 58b. The fluid flows from conduit 59a, via lead conduit 100, into distributor/collector conduit 104 where its flow is split, part going into branch conduit 106 and part into branch conduit 108. The fluid in branch 106 flows through now-opened valve 116c and into ram cylinder 14 via lead conduit 15. Similarly, the fluid in branch conduit 108 flows through now-opened valve 118c and into ram cylinder 16 via lead conduit 17.

The auxiliary system fluid entering ram cylinders 14 and 16 tends to push the pistons therein, as indicated by arrows 124 and 126, to generate a turning moment on the stock (indicated at 138 in FIG. 1) of rudder 11. In order to facilitate turning of the rudder, any residual fluid in ram cylinders 12 and 18 is simultaneously allowed to exit therefrom via lead conduits 13 and 19, respectively, and through conduits 112 and 114, respectively, via now-opened valves 120c and 122c, respectively. The exiting fluid in conduits 112 and 114 flows into collector/distributor conduit 110 and back into control valve 58 through lead conduit 102. The fluid flows through conduit 59b of chamber 58b and is returned to reservoir 20 via conduit 55, reservoir-return conduit 86 and reservoir inlet 21.

Left Turn Maneuver

Figure 6:
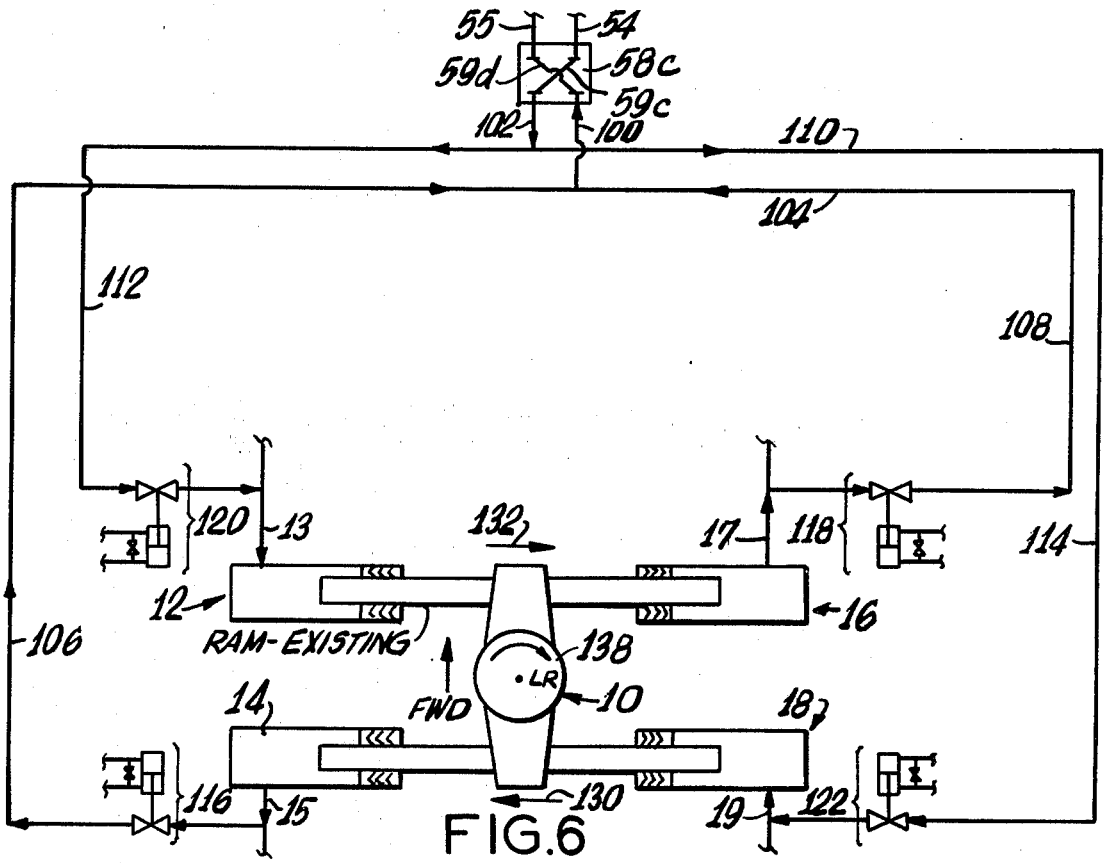
FIG. 6 illustrates the fluid flow pattern in the same system portion as FIG. 5, for a left turn maneuver.

Turning then to FIG. 6, there is shown the fluid flow pattern in the auxiliary directional control sub-system for the left turn maneuver. In operation, auxiliary system fluid flowing through conduit 54 and flow control 62 is led into flow control valve 58 wherein left-turn control chamber 58c has been positioned in the flow path of control valve 58 by actuator 200. The fluid flows through conduit 59c of chamber 58c and into collector/distributor conduit 110 via lead conduit 102. In conduit 110, the flow of the fluid is split, part going into branch conduit 112 and the other part into branch conduit 114. The portions of fluid in conduits 112 and in conduit 114 flow, respectively, into ram cylinders 12 and 18, via now-opened valves 120c and 122c, respectively, and lead conduits 13 and 19, respectively.

The fluid entering ram cylinders 12 and 18 tends to push the pistons therein, as indicated by arrows 130 and 132 in FIG. 6, to generate a turning moment on rudder stock 138. In addition, residual fluid in ram cylinders 14 and 16 is simultaneously enabled to exit therefrom through lead conduits 15 and 17, respectively, and branch conduits 106 and 108, respectively, (via now-opened valves 116c *and 118c*, respectively). The exiting residual fluid in conduits 106 and 108 flows into distributor/collector conduit 104 and thence into lead conduit 100. Fluid in conduit 100 flows through conduit 59d of chamber 58c and back to reservoir 20 via conduit 55, as described above.

It will be understood that once the auxiliary steering control system has been initiated, it can continue to operate for a relatively long period of time (e.g., about one-half hour) since pump 24 will continue to furnish fluid for the system from reservoir 20 which is continuously being replenished by returning fluid. This should allow more than ample time to maneuver, for example, out of the way of other vessels in crowded waters or away from shallow water. In addition, since, once the by-pass control sub-system is completed, it will remain in such configuration, the pump need only provide fluid for the directional control portion of the auxiliary steering control system so that adequate fluid will be available for enabling relatively numerous maneuvers of about 25°–35° each side, port and starboard, of the midship rudder position.

Fluid Initiation of Auxiliary Control

Figure 7:
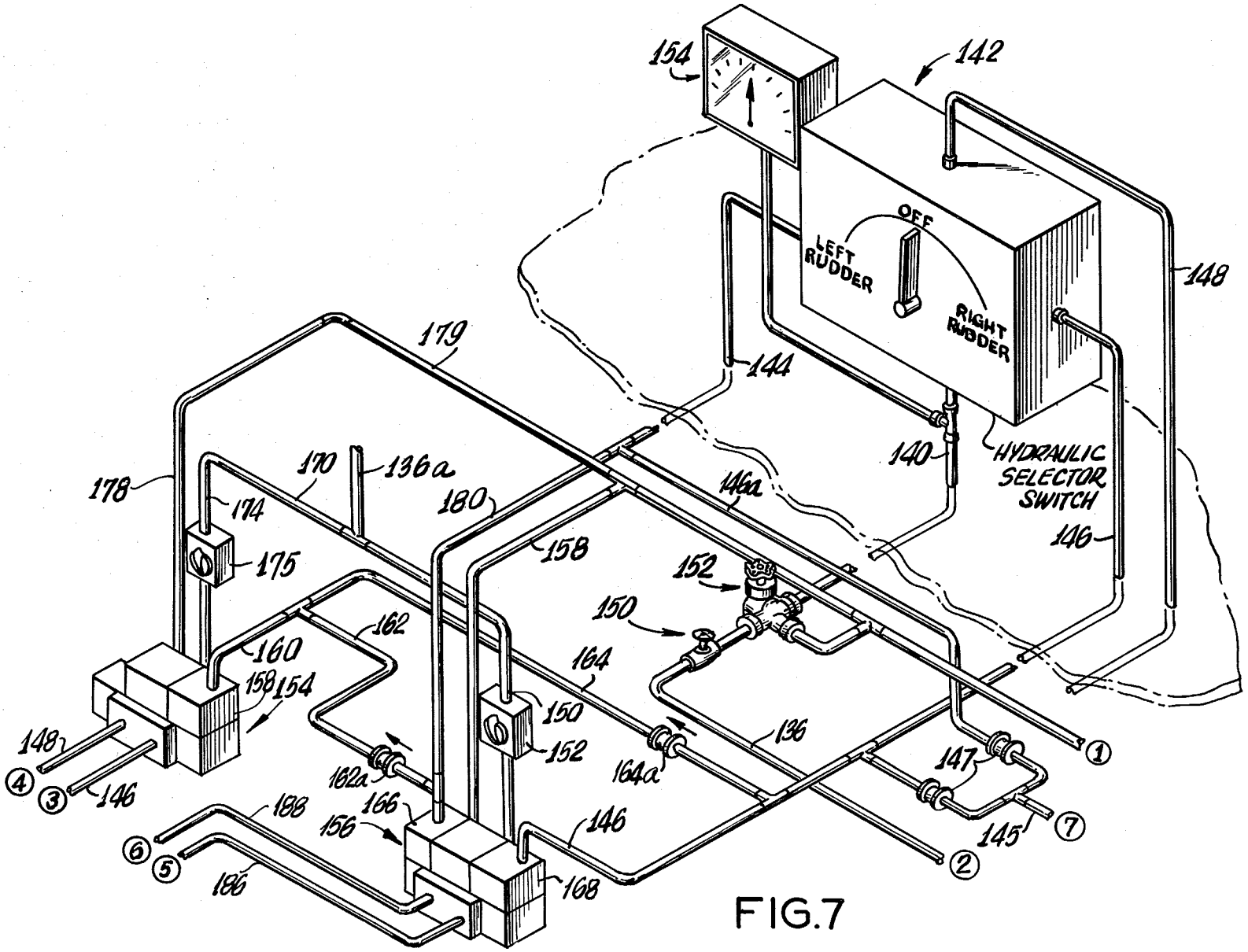
FIG. 7 is a perspective view of an embodiment of another aspect of the auxiliary steering control system according to another aspect of the invention.
Figure 8:
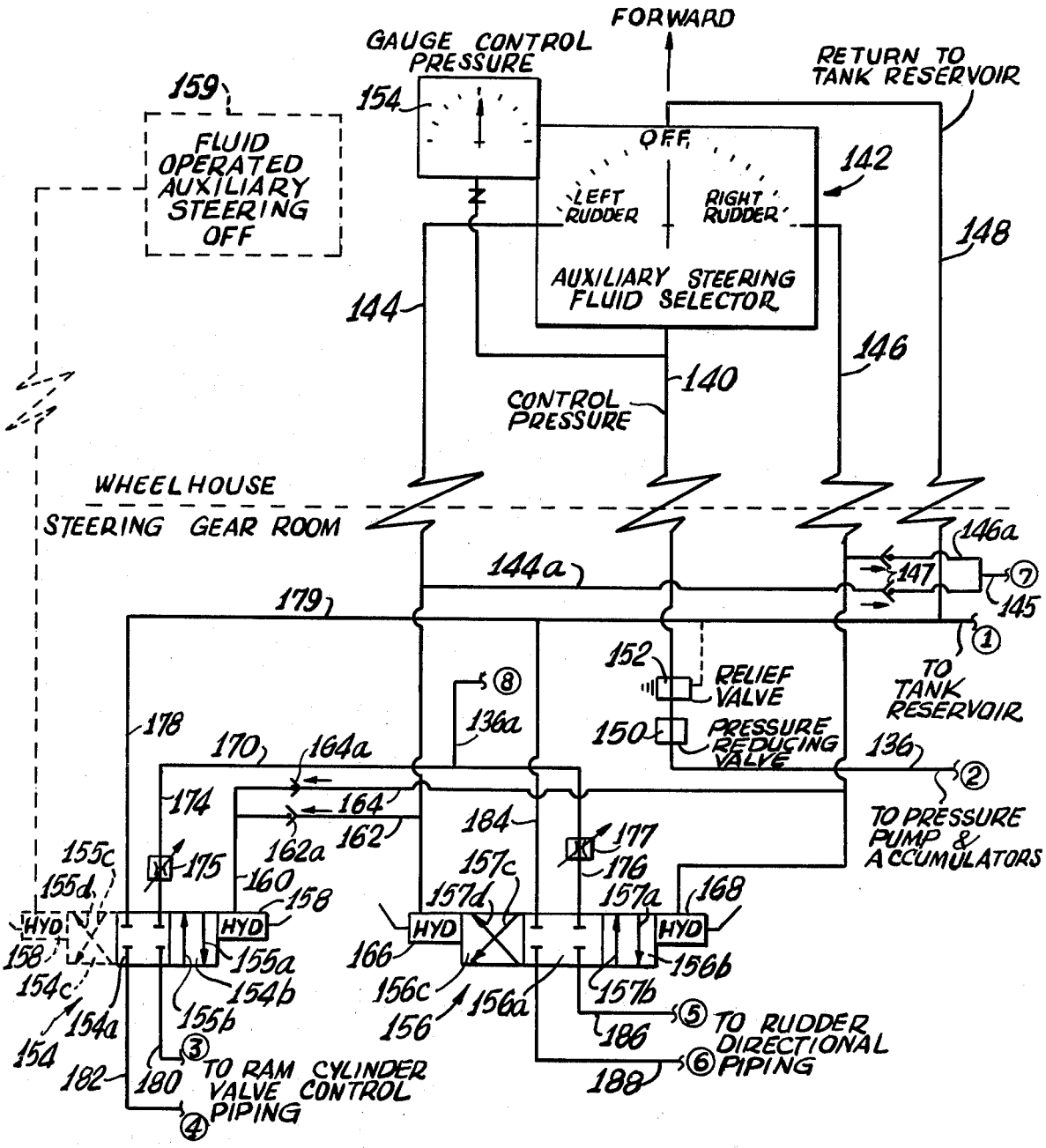
FIG. 8 is a diagramatic view of the system shown in FIG. 7.

Referring now to FIGS. 7 and 8, there is illustrated still another aspect of the auxiliary steering control system according to the invention. In this aspect, both the by-pass control sub-system and the auxiliary directional control sub-system are adapted to be operated completely by pressurized fluid from the stored-energy fluid power sub-system which has been described above. Also, as preferably embodied, the fluid-operated auxiliary steering control system is combined with the electrically operated auxiliary steering control system, described above. Such combination is particularly advantageous where the electrical auxiliary steering control system operates from the vessel's main electrical system. Thus, since the inoperability of the main steering control system could be caused by failure in the main power system, at least limited auxiliary control of the steering apparatus will be possible by the fluid-operated auxiliary steering control system.

According to this aspect of the invention, actuating means are provided for enabling pressurized fluid in the stored-energy fluid power sub-system to be coupled to a fluid-operated by-pass control sub-system for isolating the main steering control system from the steering apparatus and to a fluid-operated directional control sub-system for enabling control of the steering apparatus by fluid in the stored-energy sub-system. To this end, conduit 136 is coupled at one end, via conduit 138, to conduit 34 (as indicated at ② FIGS. 2 and 8) of the stored-energy fluid power sub-system and at its other end, via conduit 140, to auxiliary system fluid selector 142 (FIGS. 7 and 8).

Fluid selector 142 is adapted to couple the pressurized fluid from the stored-energy fluid power sub-system either to left rudder lead conduit 144 or to right rudder lead conduit 146. From either lead conduit, the pressurized fluid is thence introduced into the fluid-operated by-pass sub-system which will be described more fully below. However, selector 142 is adapted to prevent flow of the pressurized fluid to either lead conduit 144 or 146, when the selector is in the "OFF" position. Such flow prevention can be carried out, preferably, by a flow-blocking mechanism within selector 142 or by use of a return conduit 148 which couples the fluid in conduit 40 to reservoir 20 via conduit 179 which is described more fully below.

Since selector 142 will usually be located in the bridge, wheel house or other area where several persons are likely to be near-by, conduit 140 may be adapted to furnish pressurized fluid to selector 142 at a reduced pressure relative to the pressure generated in the stored-energy fluid power system—e.g., at about 10% of the stored-energy pressure. As here embodied, pressure reducing valve 150 is located in conduit 140 to reduce the pressure therein to such desired level. In addition, pressure relief valve 152 may be coupled between conduit 140 and reservoir 20 (as by coupling to conduit 179, described below) to by-pass the flow of any fluid through conduit 140 when the pressure exceeds a predetermined level—e.g., 10%–20% in excess of the desired reduced pressure in conduit 140.

Advantageously, pressure gauge 154 may be coupled to conduit 140, near the connection of conduit 140 to selector 142. Gauge 154 will be useful in monitoring the available pressure in conduit 140 and, therefore, the available "fluid power" of pressurized fluid in the stored-energy fluid power sub-system, as well as providing a check against leakage in the stored-energy sub-system.

Accordingly, a quantity of pressurized fluid is constantly supplied to selector 142 by accumulators 36, as well as pump/motor 24/26. The pressurized fluid can thereby be used not only to operate the steering mechanism as described more fully below but also to enable initiation of auxiliary steering control.

Fluid-Operated By-Pass System

Left rudder and right rudder lead conduits 144 and 146 are both operably coupled both to a fluid-actuated by-pass control valve (indicated generally at 154) and to a fluid-actuated direction control valve (indicated at 156). Lead conduit 144 is coupled to the actuator chamber valve (indicated at 158) of by-pass control valve 154 by the combination of conduits 160 and 162. Lead conduit 146 is similarly coupled to actuator chamber valve 158 by the combination of conduits 160 and 164. Both conduits 162 and 164 preferably include one-way, or check, valves (indicated at **162*a* and 164*a*, respectively) for enabling flow only in one direction (as indicated by the arrows in FIGS. 7 and 8) to prevent fluid in either of conduits 144 or 146 from back-flowing into the other. Left rudder lead conduit 144 is also coupled directly to actuator chamber valve 166 of directional control valve 156 and right rudder lead conduit 146 is coupled directly to actuator chamber valve 168 of directional control valve 156**, which will be described more fully below.

Lead conduits 144 and 146 are also both coupled to conduit 145 by conduits **144*a* and 146*a*, respectively. Conduit 145, in turn, is coupled to actuator valve H (as indicated at ⑦ in FIGS. 1–2 and 7–8) which is operatively coupled to flow control valve 52. In addition, conduits 144*a* and 146*a* are preferably provided with one-way valves (each indicated at 147) to prevent fluid from either of lead conduits 144 or 146** from flowing into the other.

Valve 52 governs the flow of fluid through conduit **136*a* which is coupled to the stored-energy fluid power sub-system by conduit 138. Conduit 136*a* is coupled at its other end to distribution conduit 170 which, in turn, is coupled both to lead conduit 174 leading into by-pass control valve 154 and to lead conduit 176 leading into directional control valve 156**.

Lead conduits 174 and 176, like lead conduits 54 and 56 which are described above, are provided with flow control devices (indicated at 175 and 177, respectively) for permitting control of the fluid flow therethrough. In addition, conduits **144*a* and 146*a* are preferably provided with one-way valves (each indicated at 147) to prevent fluid from either of lead conduits 144 or 146** from back-flowing into the other.

Also coupled to by-pass control valve 154 is exit conduit 178 which provides flow communication to reservoir 20 via collector conduit 79, as indicated at ① in FIGS. 1–2 and 7–8. In addition, conduits 180 and 182 are coupled to by-pass control valve 154, on the other side from conduits 174 and 178. Lead conduits 180 and 182 are also coupled to distribution/collector conduits 66 and 80, respectively, as indicated at ③ and ④, respectively, in FIGS. 1–2 and 7–8.

It will be understood that by-pass control valve 154 is similar to by-pass control valve 60 described above with reference to FIGS. 1 and 2 except that it is a fluid-actuated valve rather than an electrically actuated valve. Thus, the positioning of flow-blocking chamber **154*a* and flow-permitting chamber 154*b* in the flow path of valve 158 (i.e., relative to conduits 174 and 178 on the one hand and conduits 180 and 182 on the other hand) is governed by fluid-operated actuator valve 158**.

In operation, when initiation of fluid-operated auxiliary steering control is desired, selector 142 is positioned in the desired heading—i.e., to the right rudder or the left rudder position. Pressurized fluid from the stored-energy sub-system is thereby permitted to flow through conduit 140 and into either both left rudder lead conduit 144 and conduit 162 or both right rudder lead conduit 146 and conduit 164, depending on the direction chosen on selector 42. The fluid in either lead conduit can thence flow into actuator chamber 158, via conduit 160, causing the flow-enabling chamber **154*b* to replace flow-blocking chamber 154*a* in the flow path of by-pass control valve 154. Thus, conduit 155*a* will provide flow communication between conduits 174 and 180 and conduit 155*b* will provide flow communication between conduits 178 and 182**.

Simultaneously with the actuation of control valve 154, fluid in the selected lead conduit (i.e., conduit 144 or 146) will also flow into conduit 145, via either conduit **144*a* or 164*a*, respectively. Fluid flowing in conduit 145 will enter the chamber of valve H (FIGS. 1 and 2), thereby causing valve 52 to open. Once valve 52 is opened, pressurized fluid in the stored-energy fluid power sub-system can flow into by-pass control valve 154 via conduits 138, 136*a*, 170 and 174**.

Pressurized fluid entering valve 154 thence passes through conduit **155*a* of flow-enabling chamber 154*b* and into conduit 180. From conduit 180, the fluid flows into distribution conduit 66 from which it flows into valve chambers, 72*a*, 74*a*, 92*a* and 94*a*, for closing valves 72*c*, 74*c*, 92*c* and 94*c*, respectively, as well as into valve chambers 120*a*, 118*a*, 116*a* and 122*a* for opening valves 120*c*, 118*c*, 116*c* and 122*c*, respectively, substantially as described above with reference to FIGS. 1, 2 and 4**.

At the same time, conduit **155*b* provides flow communication between conduit 182 and conduit 178 which leads back to reservoir 20 via conduit 179. Thus, any residual fluid collected in collector conduit 80 (FIGS. 1 and 2) from cylinders 72*a*, 74*a*, 92*a*, 94*a*, 116*a*, 118*a*, 120*a* and 122*a* (as described above with reference to FIG. 4) will be permitted to flow to reservoir 20 via conduits 182, 155*b*, 178 and 179**.

Accordingly, the main steering control system (indicated by piping elements 73, 75, 93, and 95) will be operably isolated from steering apparatus 10, while the auxiliary steering control conduits (indicated by elements 106, 108, 112 and 114) are operatively coupled to ram cylinders 14, 16, 12 and 18, respectively, also as described above with reference to FIG. 4.

Fluid-Operated Directional Control System

As indicated above, left rudder lead conduit 144 and right rudder lead conduit 146 are also coupled, respectively, to actuator chambers 166 and 168 of directional control valve 156. Control valve 156 is similar to control valve 58 (described above with reference to FIGS. 1 and 2) except that it is acutated by fluid rather than electricity. Thus, control valve 156 has flow-blocking chamber **156*a*, right rudder flow-enabling chamber 156*b* and left rudder flow-enabling chamber 156*c*, which are similar to chambers 58*a*, 58*b* and 58*c***, respectively.

Input lead conduit 176 and exit lead conduit 184 are coupled to one side of control valve 156, and lead conduits 186 and 188 are coupled to the other side. Input lead conduit 176 is coupled to the stored-energy fluid power sub-system by conduits 170 and 136*a*, and conduit 184 is coupled to reservoir 20 by conduit 179. In addition, lead conduits 186 and 188 are coupled, respectively, to distributor/collector conduits 104 and 110, as indicated at ⑤ and ⑥, respectively, in FIGS. 1–2 and 7–8. Therefore, the desired pattern of flow communication between lead conduits 176 and 184 on the one hand and conduits 186 and 188 on the other hand are determined by the particular flow-enabling chamber (156*b* or 156*c*)positioned in the flow path of valve 156.

Right Turn Maneuver

When actuator 142 is moved to the right rudder position, fluid flows from the stored-energy sub-system, through conduit 146 and into chamber 158 to position flow-enabling chamber 154*b* in the flow path of control valve 158. The main steering control system is thereby isolated from the steering apparatus and the auxiliary steering control system is thereby coupled to the steering apparatus, as described above. At the same time, fluid from conduit 146 is also introduced into actuator chamber 168 of directional control valve 156, thereby positioning flow-enabling chamber 156*b* in the flow path of directional control valve 156. Thus, conduit 157*a* provides flow communication between input lead conduit 176 and lead conduit 186, and conduit 157*b* provides flow communication between exit conduit 184 and conduit 188.

Therefore, fluid from the stored-energy fluid power sub-system can flow into distributor/collector conduit 104 via conduits 138, 136*a*, 170, 176, 157*a* and 186. Once in distributor/collector conduit 104, the fluid flows into ram cylinders 14 and 16, to rotate rudder stock 138 in the direction of arrows 124 and 126 as described above with reference to FIG. 5. In addition, distributor/collector conduit 110 is coupled to reservoir 20 via conduits 188, 157*b*, 184 and 179. Accordingly, residual fluid in ram cylinders 12 and 18 can return to reservoir 20 to relieve any fluid resistance to movement of the rams, also as described above with reference to FIG. 5.

Left Turn Maneuver

When actuator 142 is moved to the left rudder position, pressurized fluid from the stored-energy sub-system will flow into left rudder lead conduit 144 so that the main steering control system will be isolated from the steering apparatus and the auxiliary steering control system will be coupled to the steering apparatus, substantially as described above. Of course, it will be understood that if auxiliary steering control had already been initiated, it will continue to control the steering apparatus since the fluid pressure in conduit 160 (and, therefore, actuator valve chamber 158) remains constant.

Fluid in left rudder lead conduit 144 also flows into actuator valve chamber 166 of directional control valve 156, causing left rudder flow-enabling chamber 156*c* to be positioned in flow communication with conduits 176 and 184. (If a right rudder maneuver had previously been made, conduits 144 and 146 are preferably coupled to return conduit 148 via suitable porting within selector 142 so that any residual fluid in chambers 166 and 168, respectively, will automatically be returned to reservoir 20 when the selector is moved to either the left or right rudder position).

Fluid from the stored-energy fluid power system can then flow into distributor/collector conduit 110 through conduits 138, 136*a*, 170 and 176, via conduits 157*c* and 188. Fluid in conduit 110 will thus flow into ram cylinders 12 and 18 to rotate rudder stock 138 in the direction of arrows 130 and 132 as described above with reference to FIG. 6.

At the same time, distributor/collector conduit 104 is coupled to reservoir 20 by conduits 184 and 179, via conduits 186 and 157*d*. Therefore, any residual fluid in ram cylinders 14 and 16, which collects in conduit 104, will be permitted to flow to reservoir 20 to prevent any fluid resistance to movement of the rams, also as described above with reference to FIG. 6.

As indicated above, fluid-operated directional control valve 156 and the fluid-operated by-pass control valve 154 are both fluid-actuated four-way directional control valves controlled directly by fluid in conduits 144 and 146. Control valve 156, may, for example, be a hydraulically-actuated four-way directional control valve, spring centered with dual hydraulic actuators such as the Series DG–3S4 (closed center, all ports) sold by Vickers, Inc. Control valve 154 may, for example, be a hydraulically actuated four-way directional control valve, spring offset with a single hydraulic actuator such as sold by Vickers, Inc. under the same Series designation.

It will be understood that the two one-way valves indicated at 147 are useful in preventing fluid in one of lead conduits 144 or 146 from flowing into the other. Such flow would otherwise cause both actuator chambers 166 and 168 to be filled and, thereby, prevent either flow-enabling chamber, 156*b* or 156*c* from being positioned in the flow path of valve 156. Similarly, one-way valves 162*a* and 164*a* prevent fluid in either lead conduit 144 or 146 from flowing into both actuator chambers 166 and 168.

In an alternate embodiment (not shown), conduit 136*a* and valve assembly H/52 can be eliminated along with conduits 144*a*, 146*a* and 145. Instead, conduit 136 can be coupled both to lead conduit 140 and to distributor conduit 170, since fluid initiation of auxiliary steering control can be prevented by blocking chambers 154*a* and 156*a*. However, the embodiment described with reference to FIG. 8 is preferred since valve assembly H/52 provides additional protection against inadvertent initiation of fluid-actuated auxiliary control by, for example, leakage in or complete failure of either blocking chambers 154*a* or 156*a*.

It will also be understood that the steering capability provided by the fluid-actuated auxiliary steering control according to the present invention is limited to the amount of pressurized fluid available from the stored-energy fluid power system. Thus, if pump/motor 24/26 is rendered inoperable, auxiliary steering control will be provided only to the extent of the fluid stored in accumulators 36. Nonetheless, emergency steering capability is available despite failure of virtually all of the ship's systems since both initiation of and directional control by the auxiliary steering control system are effected completely by the stored fluid under pressure.

Return To Main Steering Control

Once the defect in the main steering control system, or whatever the cause of inoperability of the main steering control system, has been remedied, control of the steering apparatus will be returned to the main steering control system. This may be accomplished, for example, by manual reset devices (each indicated at 208) associated with each valve actuating chamber 72a, 74a, 92a, and 94a for opening valve members 72c, 74c, 92c and 94c, respectively, thereby coupling the ram cylinders to the main steering control system. Manual reset devices 208 are also associated with valve chambers 116a, 118a, 120a and 122a for closing valve members 116c, 118c, 120c and 122c to isolate the auxiliary directional control valves 58 and 156 from the ram cylinders.

Fluid-actuated by-pass control valve 154 may be reset by a suitable manual reset device, or, preferably, by an internal spring return in valve 154 with chamber 158 being internally drained to conduit 178 for positioning flow-blocking chamber 154a back in the flow path of control valve 154. Similarly, manual reset devices, or, preferably, internal drains in control valve 156, are associated with actuator valve chambers 166 and 168 for re-positioning flow-blocking chamber 156a in the flow path of control valve 156. Solenoid-actuated control valves 58 and 60 may also be automatically reset by internal spring return devices when the solenoid controls (SOL) have been de-energized.

However, according to another aspect of the invention, isolation of the auxiliary directional control conduits from the steering apparatus as well as re-coupling of the main steering control apparatus to the steering apparatus may be conveniently accomplished by the by-pass control valves, 154 or 60. Although this aspect of the invention is described only with respect to the fluid actuated auxiliary control system, it will be readily appreciated that it is equally applicable to electrically operated by-pass control valve 60.

Referring again to FIG. 8, by-pass control valve 154 may include a flow-reversal chamber indicated in phantom at 154c. Chamber 154c may be positioned in the flow path of control valve 154 by any suitable means such as a manually operated positioning device (not shown) or a fluid-operated control chamber (indicated at 158) which is coupled to an actuator (indicated at 159) and a source of fluid (e.g. pump/motor 24/26 which should have resumed operation).

In operation, when control of the steering apparatus is to be returned to the main steering control system, flowreversal chamber 154c is positioned in the flow path of control valve 154, with conduit 155c coupling lead conduit 174 to conduit 182 and conduit 155d coupling exit conduit 178 to conduit 180. Accordingly, fluid from the stored-energy fluid power sub-system will flow into distributor conduit 80, from conduit 170, and thence into conduits 78, 98, 76 and 96. The fluid then flows into the appropriate portions of cylinders 72a, 74a, 92a, and 94a to open valves 72c, 74c, 92c and 94c, respectively, and into the appropriate portions of cylinders 120c, 118a, 116a and 122a to close valves 120c, 118c, 116c, respectively.

At the same time, any residual fluid in the various cylinders can be collected in collector conduit 66 via conduits 68, 70, 88 and 98 and returned to reservoir 20 through conduits 180, 155d, 178 and 179. Once the appropriate closure and opening of valves has been completed, the flow-blocking chamber 154a can be re-positioned back into the flow-path of valve 154.

Advantageously, by-pass valves (indicated at 210) may be coupled between the entrance and exit conduits associated with each of the shut-off valve assemblies in the by-pass control system to enable manual override in the event, for example, damage occurs to any of these assemblies or any are accidentally activated.

It will be understood by those skilled in the art that the size of the conduits in the directional control portion of the auxiliary steering control system may be generally comparable to that in the main control system - e.g. from about ½" to about 4" in diameter, depending on the size of steering apparatus 10. However, they may be somewhat reduced in size since the movement of the rudder will be "slower" than under the main steering control. The size of the conduits in the by-pass control portion of the auxiliary control system may be generally smaller (e.g., about ½" to about 1" in diameter) since it is intended only to operate the various shut-off valve assemblies.

Since the fluid of the auxiliary steering control flows in portions of the same piping as the main steering control steering fluid, it is preferred that the auxiliary system fluid is the same type as the main system fluid. In addition, it will be understood that the by-pass control system could be a pneumatically operated system or other suitable actuation system for isolating the main steering control system for the steering apparatus and coupling the auxiliary directional control system to the steering apparatus, since the by-pass function and the directional control function can be carried out independently of each other.

It will be readily appreciated by those skilled in the art that the invention in its broader aspects is not limited to the specific embodiments herein shown and described. Thus, for example, the number of accumulators 36 may be increased or decreased depending on the size of apparatus 10 to be operated thereby. Moreover, the invention may be adapted for use in any fluid-operated steering systems, including, but not limited to, hydraulic-fluid-operated systems of pneumatically operated systems. Accordingly, it will be understood that variations may be made from the specific embodiments disclosed herein, which are within the scope of the accompanying claims, without departing from the principles of the invention and without sacrificing its chief advantages.

What is claimed is:

1. An auxiliary steering control system for controlling fluid-operated steering apparatus in ships, boats and the like when the main steering control system has been rendered defective, which comprises:

a stored-fluid power sub-system adapted to provide a quantity of fluid under pressure;

first control means adapted to provide directional control of the steering apparatus with fluid from said stored-fluid power sub-system, said first control means enabling both left and right turn maneuvering of the steering apparatus;

second control means adapted to provide operable coupling of said first control means to the steering apparatus, said stored-fluid power sub-system and said first and said second control means being essentially independent from the main steering control system such that when control of the steering apparatus by said auxiliary steering control system is desired, said second control means can be activated to enable operation of the steering apparatus by fluid in the stored-fluid power sub-system via said first control means.

2. A system according to claim 1, wherein said second control means is adapted both to isolate the main steering control system from operable coupling with the steering apparatus and to provide operable coupling of said first control means to the steering apparatus.

3. A system according to claim 2, wherein said second control means comprise:

fluid-actuated first isolation valve means associated with the main steering control system, said first isolation valve means adapted to isolate the main steering control system from the steering apparatus;

fluid-actuated second isolation valve means associated with the steering apparatus, said second isolation valve means adapted to couple said first control means to the steering apparatus; and by-pass control valve means associated with said stored-fluid power sub-system, said by-pass control valve means adapted to provide, when desired, flow communication between fluid in said stored-fluid power sub-system and both said first and second isolation valve means, such that when control of the steering apparatus by said auxiliary control system is desired, fluid flows from said stored-fluid power sub-system to said first and second isolation valve means for isolating the main steering control system from the steering apparatus and for coupling the first control means to the steering apparatus.

4. An auxiliary steering control system for controlling fluid-operated steering apparatus in ships, boats and the like when the main steering control system has been rendered defective, which comprises:

a stored-fluid power sub-system adapted to provide a quantity of fluid under pressure;

first control means adapted to provide directional control of the steering apparatus with fluid from said stored-fluid power sub-system; and second control means adapted both to isolate the main steering control system from operable coupling with the steering apparatus and to provide operable coupling of said first control means to the steering apparatus, said second control means comprising:

fluid-actuated first isolation valve means associated with the main steering control system, said first isolation valve means adapted to isolate the main steering control system from the steering apparatus, fluid-actuated second isolation valve means associated with the steering apparatus, said second isolation valve means adapted to couple said first control means to the steering apparatus, and by-pass control valve means associated with said stored-fluid power sub-system, said by-pass control valve means adapted to provide, when desired, flow communication between fluid in said stored-fluid power sub-system and both said first and second isolation valve means, such that when control of the steering apparatus by said auxiliary control system is desired, fluid can be made to flow from said stored-fluid power sub-system to said first and second isolation valve means for isolating the main steering control system from the steering apparatus and for coupling the first control means to the steering apparatus and directional control of the steering apparatus can be carried out with said fluid by said first control means.

5. A system according to claim 3 or 4, wherein said by-pass control valve means include:

an electrically operated by-pass control valve operable from a location remote of the steering apparatus; and a fluid operated by-pass control valve operable from a location remote of the steering apparatus.

6. A system according to claim 5, wherein said fluid operated by-pass control valve is operably coupled to said stored-energy system for control by fluid therefrom, such that the main steering control system can be by-passed despite any failure of electrical power supply.

7. A system according to claim 5, wherein said first isolation valve means include a fluid-operated shut-off valve located in each conduit of the main steering control system leading to the steering apparatus, each said shut-off valve being coupled to said stored-fluid power sub-system by both said electrically operated and said fluid operated by-pass control valves for closing its corresponding main system conduit when fluid flows through one of said by-pass control valves.

8. A system according to claim 3 or 4, wherein said first control means comprise:

fluid conduit means adapted to provide flow communication between said stored-fluid power sub-system and the steering apparatus and to permit fluid flow into and out of the steering apparatus; and directional control valve means adapted to control the flow of fluid from stored-fluid power sub-system, through said hydraulic conduit means, and into and out of the steering apparatus for enabling operation of the steering apparatus by said auxiliary control system.

9. A system according to claim 8, wherein said directional control valve means include:

an electrically operated directional control valve operable from a location remote of the steering apparatus; and a fluid operated directional control valve operable from a location remote of the steering apparatus.

10. A system according to claim 9, wherein said fluid operated directional control valve is operably coupled to said stored-fluid power sub-system for activation, when desired, by fluid therefrom, such that fluid may flow through said fluid conduit means for enabling directional actuation of the steering apparatus despite any failure in electrical power supply.

11. A system according to claim 1, wherein said stored-fluid power sub-system includes:

a reservoir providing a source of said fluid, said reservoir having a return inlet and a supply outlet;

accumulator means adapted to store a quantity of fluid at a relatively high pressure;

pump means coupled in flow communication between said reservoir and said accumulator means, said pump means adapted to pump fluid from said reservoir into said accumulator means; and detector means in fluid communication with said accumulator means, said detector means adapted to detect the fluid pressure in said accumulator means and said detector means coupled to said pump means for activating said pump means when the detected pressure falls below a first predetermined level and for de-activating said pump means when the detected pressure reaches a second predetermined level, such that the fluid in said accumulator means is maintained at a pressure between the first and second predetermined levels.

12. A system according to claim 11, wherein said second control means is adapted both to isolate the main steering control system from operable coupling with the steering apparatus and to provide fluid communication for fluid from said accumulator means and said pump means to the steering apparatus.

13. A system according to claim 12, wherein said second control means comprise:

fluid-actuated first isolation valve means associated with the main steering control system, said first isolation valve means adapted to isolate the main steering control system from the steering apparatus;

fluid-actuated second isolation valve means associated with the steering apparatus, said second isolation valve means adapted to couple said first control means to the steering apparatus; and by-pass control valve means associated with said stored-fluid power sub-system, said by-pass control valve means adapted to provide, when desired, flow communication between fluid in said accumulator means and both said first and second isolation valve means, such that when control of the steering apparatus by said auxiliary control system is desired, fluid can flow from said accumulator means to said first and second isolation valve means for isolating the main steering control system from the steering apparatus and for coupling the first control means to the steering apparatus.

14. An auxiliary steering control system for controlling fluid-operated steering apparatus in ships, boats and the like when the main steering control system has been rendered defective, comprising:

a stored-fluid power sub-system adapted to provide a quantity of fluid under pressure, said stored-fluid power sub-system including:

a reservoir providing a source of said fluid, said reservoir having a return inlet and a supply outlet, accumulator means adapted to store a quantity of fluid at a relatively high pressure, pump means coupled in flow communication between said reservoir and said accumulator means, said pump means adapted to pump fluid from said reservoir into said accumulator means, and detector means in fluid communication with said accumulator means, said detector means adapted to detect the fluid pressure in said accumulator means and said detector means coupled to said pump means for activating said pump means when the detected pressure falls below a first predetermined level and for de-activating said pump means when the detected pressure reaches a second predetermined level, for maintaining the fluid in said accumulator means at a pressure between the first and second predetermined levels;

first control means adapted to provide directional control of the steering apparatus with fluid from said stored-fluid power sub-system; and second control means adapted both to isolate the main steering control system from operable coupling with the steering apparatus and to provide fluid communication for fluid from said accumulator means and said pump means to the steering apparatus, said second control means including:

fluid-activated first isolation valve means associated with the main steering control system, said first isolation valve means adapted to isolate the main steering control system from the steering apparatus, fluid-actuated second isolation valve means associated with the steering apparatus, said second isolation valve means adapted to couple said first control means to the steering apparatus, and by-pass control valve means associated with said stored-fluid power sub-system, said by-pass control valve means adapted to provide, when desired, flow communication between fluid in said accumulator means and both said first and second isolation valve means, such that when control of the steering apparatus by said auxiliary control system is desired, fluid can flow from said accumulator means to said first and second isolation valve means for isolating the main steering control system from the steering apparatus and for coupling the first control means to the steering apparatus and directional control of the steering apparatus can be carried out with said fluid by said control means.

15. A system according to claim 13 or 14, wherein said first isolation valve means comprise:

a shut-off valve located in each conduit coupling the main steering control system to the steering apparatus; and a fluid-operated actuation chamber governing said shut-off valve, said actuation chamber having in inlet coupled to said by-pass control valve means for receiving fluid from said by-pass control valve means to close said shut-off valve; and, wherein said by-pass control valve means is also adapted to provide further flow communication between an outlet of said actuation chamber and the return inlet of said reservoir for permitting any residual fluid in said actuator chamber, tending to resist flow of fluid into the inlet of said actuator chamber, to flow into said reservoir.

16. A system according to claim 15, wherein said by-pass control valve means include:

an electrically operated by-pass control valve adapted to permit, when activated, fluid from said accumulator means and said pump means to flow into each said actuation chamber; and a fluid operated by-pass control valve adapted to permit, when activated, fluid from said accumulator means and said pump means to flow into each said actuation chamber, said fluid operated by-pass control valve utilizing fluid from said accumulator means and said pump means for operation, such that one of said by-pass control valves can be activated for enabling control of the steering apparatus by said auxiliary control system when electrical power is available as well as when electrical power is unavailable.

17. A system according to claim 13 or 14, wherein said first control means comprise:

fluid conduit means adapted to provide flow communication between said accumulator means and the steering apparatus to enable fluid flow into and out of the steering apparatus; and directional control valve means adapted to control the flow of fluid from said accumulator means and said pump means, through said hydraulic conduit means, and into and out of the steering apparatus.

18. A system according to claim 17, wherein said directional control valve means is also adapted to provide flow communication between the steering apparatus and the return inlet of said reservoir for permitting any residual fluid in the steering apparatus, tending to resist flow of fluid into the steering apparatus, to flow into said reservoir.

19. An auxiliary steering control system for controlling fluid operated steering apparatus in ships, boats and the like in the event the main steering control system has been rendered defective or inoperable, which includes:

a stored-fluid system providing at least a quantity of fluid under pressure for operating the steering apparatus, said stored-fluid system being essentially independent of the main steering control system;

a first actuator system adapted to enable, when initiated, directional control of the steering apparatus by fluid from the stored-fluid system, independently of the main steering system, said first actuator system enabling both left and right turn maneuvering of the steering apparatus; and a second actuator system adapted to enable, when initiated, directional control of the steering apparatus by fluid from said stored-energy system, said second actuator system being powered by fluid from said stored-fluid system, such that the steering apparatus can be operated, at least for a limited time by said auxiliary control system in the event both said first actuator system and the main steering control system have been rendered defective.

20. A system according to claim 19, wherein said stored-fluid system includes electrically operated pump means adapted to maintain said quantity of fluid under pressure and to provide additional fluid under pressure to the steering apparatus when said auxiliary control system is initiated by said first actuator system.

21. A method for controlling fluid operating steering apparatus in ships, boats and the like in the event the main steering control apparatus has been rendered defective, comprising the steps of:

maintaining a quantity of fluid under pressure, essentially independently of the main steering control system;

isolating the main steering control system from operative coupling with the steering apparatus;

permitting flow communication between said fluid and the steering apparatus by means essentially independent of the main steering control apparatus; and controlling said flow of said fluid into and out of the steering apparatus for both right turn and left turn maneuvering of the steering apparatus, such that directional actuation of the steering apparatus can be carried out by said fluid, essentially independent of the main steering control system.

22. A method according to claim 21, wherein said step of isolating the main steering control system is carried out by fluid from said quantity of fluid under pressure.

23. A method according to claim 22, wherein said step of permitting flow communication includes operatively coupling said fluid to the steering apparatus by one of two directional control means, one of the directional control means being powered by said fluid maintained under pressure.

24. A method according to claim 23, wherein said step of isolating the main steering control means is carried out by one of two by-pass control means, one of the by-pass control means being powered by said fluid maintained under pressure.

25. A method for controlling fluid operating steering apparatus in ships, boats and the like in the event the main steering control apparatus has been rendered defective, comprising the steps of:

maintaining a quantity of fluid under pressure, essentially independently of the main steering control system;

isolating the main steering control system from operative coupling with the steering apparatus by one of two by-pass control means with fluid from said quantity of fluid under pressure;

permitting flow communication between said fluid and the steering apparatus by operatively coupling the fluid from said quantity thereof to the steering apparatus by one of two directional control means, one of the directional control means being powered by the fluid maintained under pressure; and controlling flow of said fluid into and out of the steering apparatus, such that directional actuation of the steering apparatus can be carried out by said fluid.

26. A method for enabling control of fluid operated steering apparatus in ships, boats and the like in the event the main steering control system has been rendered defective, comprising the steps of:

providing a quantity of fluid under pressure independently of the main steering control system;

directing flow of the fluid under pressure into and out of the steering apparatus by one of two auxiliary control actuation means which are independent of the main steering control system, and causing thereby directional actuation of the steering apparatus.

27. A method according to claim 26, wherein one of the auxiliary control actuation means is powered by the fluid under pressure.

28. A method according to claim 27, wherein said auxiliary control actuation means isolates the main steering control system from the steering apparatus and provides flow communication between said fluid under pressure to the steering apparatus.

29. A stored-energy fluid power system for providing fluid under pressure to fluid-actuated steering apparatus in ships, boats and the like, which comprises:

a source of pressurizable fluid;

pump means in flow communication with said source of fluid for pumping the fluid under pressure;

accumulator means in flow communication with said pump means for receiving fluid from said pump means, said accumulator means adapted to store the fluid under pressure;

means for substantially preventing release of fluid stored in said accumulator means until desired;

fluid actuatable first control means adapted to be coupled to the steering apparatus to provide directional control of the steering apparatus with said fluid;

fluid actuatable second control means adapted to be in flow communication with said accumulator means for governing flow communication between said first control means; and selector means in flow communication with said accumulator means, said selector means being operable to control flow communication among said accumulator means and said first and second control means, such that when said selector means is in a neutral position flow communication from said accumulator means to said first and second control means is essentially prevented and when said selector means is moved to a left rudder and to a right rudder position, flow communication is provided between said accumulator means and said first control means to establish operable flow communication between said second control means and the steering apparatus and generally simultaneously flow communication is established between said accumulator means and the steering apparatus to enable a left rudder maneuver and a right rudder maneuver, respectively.

30. A system according to claim 29, which further includes relief means in flow communication between said pump means and said source of fluid, said relief means adapted to permit fluid downstream of said pump means to flow back to said source when the fluid pressure in said accumulator means exceeds a first predetermined value.

31. A system according to claim 30, which further includes pressure switch means in flow communication with fluid in said accumulator means, said pressure switch means operatively coupled to said pump means and adapted to activate said pump means when the pressure of fluid stored in said accumulator means is below a second predetermined value and to de-activate said pump means when the pressure of fluid stored in said accumulator means reaches a third predetermined value.

32. An isolation system for isolating the main steering control system from a fluid-actuated steering apparatus in ships, boats and the like, comprising:

a source of fluid maintained, at least in part, under pressure;

by-pass control valve means in flow communication with said source of fluid, said by-pass control valve means adapted, when desired, to permit the flow of fluid from said source of fluid and to prevent the flow of fluid from said source of fluid;

a first isolation valve assembly for each fluid-receiving receptacle of the steering apparatus, each said first isolation valve assembly adapted, when desired, to permit and to prevent, fluid communication between the fluid-receiving receptacle and the main steering control system for the steering apparatus, each said first isolation valve assembly being in flow communication with said by-pass control valve means, such that when fluid is permitted to flow through said by-pass valve means, the fluid can flow into said first isolation valve assemblies to prevent flow communication between the main steering control system and the fluid-receiving receptacles.

33. An isolation system according to claim 32, which further includes a second isolation valve assembly for each fluid-receiving receptacle of the steering apparatus, each said second isolation valve assembly being in flow communication with said by-pass control valve means and being adapted, when desired, to permit and to prevent fluid communication between its corresponding fluid-receiving receptacle and a source of auxiliary directional control fluid, such that when fluid is permitted to flow through said by-pass valve means, the fluid can flow into said second isolation valve assemblies to permit flow communication between the steering apparatus and the source of auxiliary directional control fluid.

34. An auxiliary steering control system for controlling the steering apparatus in ships, boats and the like, which includes more than one means for initiating control of the steering apparatus when the main steering control system has been rendered defective, said auxiliary control system being adapted to control the steering apparatus in essentially the same manner as the main steering control system yet essentially independently of the main steering control system.

35. An auxiliary steering control system according to claim 34, which further includes more than one means for enabling operative directional control of the steering apparatus when the main steering control system has been rendered defective.

36. An auxiliary steering control system according to claim 34, which includes electrically operated auxiliary steering control initiation means and fluid operated auxiliary steering control initiation means, each adapted to enable initiation of auxiliary steering control.

37. An auxiliary steering control system according to claim 34, which includes electrically operated auxiliary steering control intiation means and fluid operated auxiliary steering control initiation means, each adapted to enable initiation of auxiliary steering control; and, electrically operated control means and fluid operated auxiliary directional control means, each adapted to enable directional control of the steering apparatus.

* * * * *